US011297952B1

(12) United States Patent
Gaillard

(10) Patent No.: US 11,297,952 B1
(45) Date of Patent: Apr. 12, 2022

(54) CHAIR ASSEMBLY WITH LIMB PLATFORM

(71) Applicant: Bruce Bernard Gaillard, Columbus, GA (US)

(72) Inventor: Bruce Bernard Gaillard, Columbus, GA (US)

( * ) Notice: Subject to any disclaimer, the term of this patent is extended or adjusted under 35 U.S.C. 154(b) by 0 days.

(21) Appl. No.: 16/912,959

(22) Filed: Jun. 26, 2020

(51) Int. Cl.

| | |
|---|---|
| ***A47C 7/54*** | (2006.01) |
| ***A47C 7/38*** | (2006.01) |
| ***A47B 3/06*** | (2006.01) |
| ***A47B 3/14*** | (2006.01) |
| ***A47C 1/00*** | (2006.01) |
| ***A61G 15/12*** | (2006.01) |
| ***A47C 7/00*** | (2006.01) |
| ***A47B 39/02*** | (2006.01) |
| ***A47B 83/02*** | (2006.01) |
| ***A61G 13/12*** | (2006.01) |

(52) U.S. Cl.

CPC ..... *A47C 7/541* (2018.08); *A47B 3/063* (2017.08); *A47B 3/14* (2013.01); *A47B 39/023* (2017.08); *A47B 83/02* (2013.01); *A47C 1/00* (2013.01); *A47C 7/002* (2013.01); *A47C 7/38* (2013.01); *A47C 7/54* (2013.01); *A47C 7/543* (2013.01); *A61G 13/124* (2013.01); *A61G 13/1235* (2013.01); *A61G 15/12* (2013.01); *A47B 2200/0096* (2013.01)

(58) Field of Classification Search

CPC ..... A47B 39/00; A47B 39/02; A47B 39/023; A47B 2200/0096; A47B 83/02; A47B 83/008; A47B 3/14; A47B 3/063; A47C 9/005; A47C 7/38; A47C 7/54; A47C 7/541; A47C 1/00; A47C 5/125; A47C 5/127; A47C 5/128; A61G 13/124; A61G 13/125; A61G 13/1235; A61G 5/00; A61G 15/12

USPC ..... 297/195.11, 423.11, 423.12

See application file for complete search history.

(56) References Cited

U.S. PATENT DOCUMENTS

| | | | | | |
|---|---|---|---|---|---|
| 355,230 | A | * | 12/1886 | Taliaferro | A47D 13/083 297/170 |
| 1,228,618 | A | * | 6/1917 | Thum | A47B 83/02 297/171 |
| 2,632,496 | A | * | 3/1953 | Cardozo, Jr. | A47B 41/02 297/171 |
| 2,669,288 | A | * | 2/1954 | Bargen | A47B 23/02 297/451.4 |
| 2,676,646 | A | * | 4/1954 | Brashear, Jr. | A47B 83/02 297/171 |
| 3,544,161 | A | * | 12/1970 | Bryden | A47C 7/38 297/391 |

(Continued)

FOREIGN PATENT DOCUMENTS

| | | | | |
|---|---|---|---|---|
| CA | 2560306 A1 | * | 10/2005 | A47C 3/20 |
| CN | 208176665 U | * | 12/2018 | |

(Continued)

*Primary Examiner* — Robert Canfield
(74) *Attorney, Agent, or Firm* — Michael D. Eisenberg

(57) ABSTRACT

A chair assembly includes a seat with a top side and a bottom side. The seat is connected to a telescoping arm that has a first end and a second end. The first end of the arm is connected to the bottom side of the seat. A platform having a top side and a bottom side is attached to the second end of the arm. The height of the platform is adjustable via the telescoping arm.

12 Claims, 6 Drawing Sheets

(56) References Cited

U.S. PATENT DOCUMENTS 3,572,831 A * 3/1971 Barecki ..... A47C 7/38 297/344.21
4,277,102 A * 7/1981 Aaras ..... A47C 1/03 297/411.36
4,767,160 A * 8/1988 Mengshoel ..... A47C 7/52 297/423.12
4,798,411 A * 1/1989 Lin ..... A47B 3/14 297/170
4,960,305 A * 10/1990 Opsvik ..... A47B 39/08 297/423.12
5,401,078 A * 3/1995 Riach ..... A47C 7/503 297/19
5,961,179 A * 10/1999 Dixon ..... A47B 21/00 297/173
5,971,485 A * 10/1999 Clark ..... A61G 13/009 297/195.11
5,988,738 A * 11/1999 Blessing ..... A47B 3/14 297/141
6,065,808 A * 5/2000 Tinsley ..... A47C 9/005 297/195.11
6,543,853 B1 * 4/2003 Splane, Jr. ..... A47C 9/005 297/195.11
6,619,733 B2 * 9/2003 Pearson ..... A47C 7/38 297/112
6,619,747 B2 * 9/2003 Ko ..... A47C 7/54 248/118.3
6,769,736 B2 * 8/2004 Roleder ..... A47C 9/005 297/195.11
7,144,080 B2 * 12/2006 Lloyd ..... A47C 9/005 297/195.11
7,488,281 B2 * 2/2009 Weir ..... A47C 9/005 482/140
2003/0090131 A1 * 5/2003 Roleder ..... A61G 15/007 297/195.11
2003/0094843 A1 * 5/2003 Jensen ..... B60N 3/004 297/391
2003/0151277 A1 * 8/2003 Chen ..... A47C 9/005 297/195.11
2003/0168899 A1 * 9/2003 Voyce, IV ..... A47C 16/04 297/423.11
2004/0133979 A1 * 7/2004 Newkirk ..... A61F 5/3761 5/600
2005/0035644 A1 * 2/2005 Lloyd ..... A61G 15/007 297/423.11
2006/0197362 A1 * 9/2006 Mabon ..... A47C 3/20 297/172
2007/0052275 A1 * 3/2007 Ghilzai ..... A47C 1/11 297/423.12
2010/0295357 A1 * 11/2010 Koehler ..... A61G 15/08 297/411.2
2013/0221710 A1 * 8/2013 Udagawa ..... A47B 39/10 297/174 R
2015/0189992 A1 * 7/2015 Richardson ..... A47C 9/00 297/195.11
2016/0256342 A1 * 9/2016 Alvarez ..... A47C 1/0308
2020/0383473 A1 * 12/2020 Fletcher ..... A47B 83/02

FOREIGN PATENT DOCUMENTS

CN 113229654 A * 8/2021
DE 1805645 A1 * 8/1970 ..... A47C 7/68
DE 102010022960 A1 * 12/2011 ..... A47C 7/402
DE 102017206393 A1 * 10/2018 ..... A61G 15/12
FR 2625660 A1 * 7/1989 ..... A47C 4/24
FR 2906446 A1 * 4/2008 ..... A47C 9/005
GB 2362315 A * 11/2001 ..... A47C 15/004
JP 02068054 A * 3/1990 ..... A47C 3/36
JP 08336437 A * 12/1996 ..... A47C 9/005
WO WO-2016081857 A1 * 5/2016 ..... A47B 13/02

* cited by examiner

CHAIR ASSEMBLY WITH LIMB PLATFORM

TECHNICAL FIELD

The present invention relates to a chair assembly, and more particularly, a chair assembly for allowing a person with an limb to sit and prop up the limb.

BACKGROUND OF THE INVENTION

Anytime an individual requires a limb to be wrapped or dressed, a person who sustains a physical injury to an limb (from a sports-related accident, for instance) may need to have the limb wrapped or treated by a coach or a trainer. The person may sit on a chair while having the injury treated. Current chair designs are often not ergonomic, as they require the person to sit and place the injured limb in such a way that is uncomfortable and may even reduce circulation to the limb. This can result in worsening or slowed healing of the injury. Placing towels or pillows on the chair or under the limb does not remedy, and may even exacerbate, this problem. Furthermore, the coach or trainer may have to position themselves in a way that is uncomfortable while treating the injury. A need thus exists for a chair that can be positioned to allow the person to sit and place the injured limb comfortably, while also allowing the coach or trainer to remain comfortable while treating the injury.

BRIEF SUMMARY OF EMBODIMENTS OF THE INVENTION

An aspect of some embodiments of the present invention relates to a chair assembly, for allowing a person having at least one limb to sit and prop up the limb, comprising: seat having a top side for sitting and a bottom side; a platform, for placement of the limb of the person, having a top side and a bottom side; and an arm having a first end joined to the seat and a second end joined to the platform. A height of the platform is adjustable along a longitudinal axis of the arm.

In a variant, the arm has the first end, a first inflexion point that is concave upward, a stem, a second inflexion point that is concave downward, and the second end. The first end of the arm is fixed to the bottom side of the seat. The bottom side of the platform is fixed to the second end of the arm and is configured to support the limb of the person resting upon the top side of the platform while the person is seated on the seat.

In another variant, an angle formed between a line parallel to the seat and a line connecting points centered along front edges of the respective seat and platform is between 30-60 degrees.

In yet another variant, at least one of inflexion points of the arm are each is set to curve at an angle of 90° with respect to the stem of the arm.

In a further variant, the arm is configured to telescope the longitudinal axis of the arm to allow adjustment of a height of the platform.

In yet a further variant, the arm is configured to pivot about a point on the arm.

In a variant, the chair assembly further comprises a first leg having a length, a first end, and a second end. The first end of the first leg is fixed to the bottom side of the seat, and the first leg extends downward along the length of the first leg to the second end of the first leg.

In yet another variant, the first leg has a straight profile.

In a further variant the chair assembly further comprises a first foot attached to the second end of the first leg. The first foot sits upon a floor.

In yet a further variant, the first foot has a curved profile, an outer arc length, and an inner arc length.

In a variant, the chair assembly further comprises a second leg having a first end, and a second end. The first end of the second leg is fixed to a point along the length of the first leg, and the second leg extends downward to the second end of the second leg.

In another variant, the second leg has a curved profile and an arc length extending downward to the second end of the second leg.

In yet another further variant, the chair assembly further comprises a second foot extending from the second end of the second leg.

In a further variant the second foot has a length, a top surface, and a bottom surface.

In yet a further variant, a pair of screws is disposed on the top surface along the length of the second foot to fix the second foot to the second end of the second leg.

In a variant, a pair of grips is disposed on the bottom surface along the length of the second foot to fix the second foot to the floor.

In another variant, the second foot has a straight profile.

Another aspect of some embodiments of the present invention relates to a chair assembly, for allowing a person having at least one limb to sit and prop up the limb. The chair assembly comprises: a seat having a top side for sitting and a bottom side; first leg having a straight profile, a length, a first end, and a second end, wherein the first end of the first leg is fixed to the bottom side of the seat, and the first leg extends downward along the length of the first leg to the second end of the first leg; a first foot attached to the second end of the first leg; wherein the first foot has a curved profile, an outer arc length, and an inner arc length, and sits upon a floor; a second leg having a curved profile, an arc length, a first end, and a second end, wherein the first end of the second leg is fixed to a point along the length of the first leg, and the second leg extends downward along the arc length of the second leg to the second end of the second leg; a second foot extending from the second end of the second leg, the second foot having a straight profile, a length, a top surface, and a bottom surface, wherein a pair of screws is disposed on the top surface along the length of the second foot to fix the second foot to the second end of the second leg, and a pair of grips is disposed on the bottom surface along the length of the second foot to fix the second foot to the floor; an arm having a first end, a first inflexion point that is concave upward, a stem, a second inflexion point that is concave downward, and a second end; wherein both inflexion points of the arm are each set to curve at an angle of 90° with respect to the stem of the arm, wherein the first end of the arm is fixed to the bottom side of the seat; and a platform, for placement of the limb of the person, having a top side and a bottom side, wherein the bottom side of the platform is fixed to the second end of the arm, and the limb of the person rests upon the top side of the platform. The angle formed between a line parallel to the seat and a line connecting points centered along front edges of the respective seat and platform is between 0-120 degrees.

A further embodiment of the present invention relates to a chair assembly, for propping up an arm of a person while seated. The chair assembly comprises: a seat having a top side for sitting and a bottom side; an arm having a first end, a first inflexion point that is concave upward, a stem, a second inflexion point that is concave downward, and a second end, wherein the first end of the arm is fixed to the bottom side of the seat; and a platform, for placement of the limb of the person, having a top side and a bottom side. The bottom side of the platform is fixed to the second end of the arm, and the limb of the person rests upon the top side of the platform. An angle formed between a line parallel to the seat and a line connecting points centered along front edges of the respective seat and platform is between 0-120 degrees.

Various objects, features, aspects, and advantages of the present invention will become more apparent from the following detailed description of preferred embodiments of the invention, along with the accompanying drawings in which like numerals represent like components.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

DETAILED DESCRIPTION OF THE EMBODIMENTS OF THE INVENTION

Figure 1:
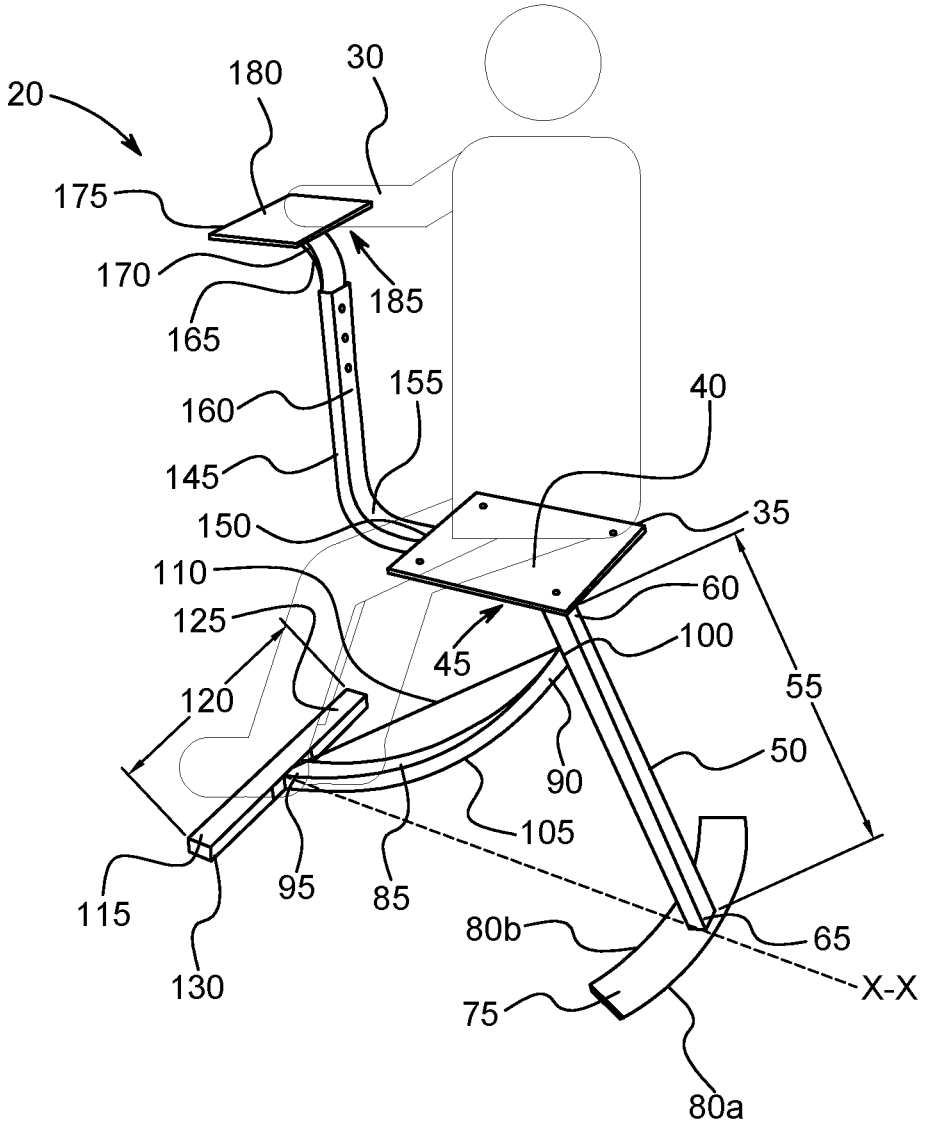
FIG. 1 is a perspective view of a chair assembly, according to an exemplary embodiment.

As first illustrated in FIG. 1, a chair assembly 20, for allowing a person 25 having at least one limb 30 to sit and prop up the limb 30 is presented. The limb 30 may be propped up for a variety of reasons, including to be wrapped in a medical cloth after the person 25 has sustained an injury. The chair assembly 20 includes a seat 35 having a top side 40 and a bottom side 45. The person 25 sits on the top side 40 of the seat 35.

Figure 3:
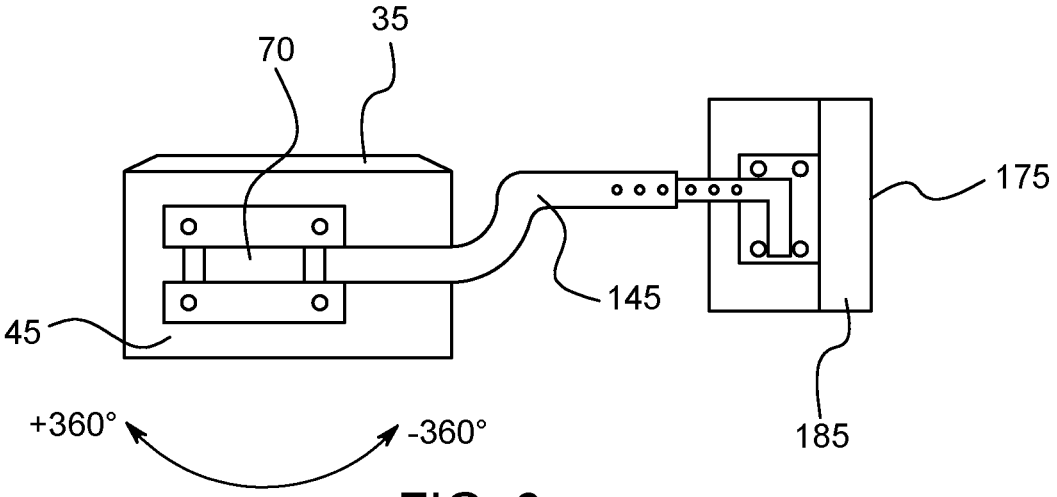
FIG. 3 is a partial bottom view of a chair assembly, according to an exemplary embodiment.

In an embodiment, the chair assembly 20 also includes a first leg 50. The first leg 50 has a length 55, a first end 60, and a second end 65. In one instance, the first leg 50 has a straight profile. The first end 60 of the first leg 50 is fixed to the bottom side 45 of the seat 35. In one instance, illustrated in FIG. 3, the first end 60 of the first leg 50 is fixed to a center point 70 of the bottom side 45 of the seat 35. The first leg 50 extends downward along the length 55 to the second end 65. In one instance, the first leg 50 is at angle of 45 degrees with respect to a horizontal axis x-x. Other variants may have the first leg 50 is at angle ranging from 30 degrees to 60 degrees with respect to a horizontal axis x-x. In a specific embodiment, a first foot 75 is attached to the second end 65 of the first leg 50. The first foot 75 sits upon a floor. In one instance, the first foot 75 has a curved profile, an outer arc length 80*a* and an inner arc length 80*b*.

In another embodiment, the chair assembly 20 further includes a second leg 85 having a first end 90 and a second end 95. The first end 90 of the second leg 85 is fixed to a point 100 along the length 55 of the first leg 50. The second leg 85 extends downward to the second end 95 of the second leg 85. In one instance, the second leg 85 has a curved profile and an arc length 105. In this instance, the second leg 85 extends downward along the arc length 105 to the second end 95 of the second leg 85. In a specific instance, the second leg 85 has a secant 110 extending from the first end 90 to the second end 95, such that the secant 110 is at an angle of 60 degrees with respect to the horizontal axis x-x. Other variants may have the second leg 85 having a secant 110 that is at an angle ranging from 45 degrees to 80 degrees.

In a further embodiment, a second foot 115 is attached to the second end 95 of the second leg 85. The second foot 115 has a length 120, a top surface 125, and a bottom surface 130. In one instance, the second foot 115 has a straight profile. In another instance, detailed in FIG. 2, a pair of screws 135 is disposed on the top surface 125 along the length 120 of the second foot 115 to fix the second foot 115 to the second end 95 of the second leg 85. In a further instance, also detailed in FIG. 2, a pair of grips 140 is disposed on the bottom surface 130 along the length 120 of the second foot 115 to fix the second foot 115 to the floor.

Central to the chair assembly 20 is an arm 145, detailed in FIG. 1. The arm 145 has a first end 150, a first inflexion point 155 that is concave upward, a stem 160, a second inflexion point 165 that is concave downward, and a second end 170. In one instance, either one of the inflexion points 155, 165 of the arm 145 is set to at an angle of 90° with respect to the stem 160 of the arm 145. In another instance, both inflexion points 155, 165 are positioned at an angle of 90° with respect to the stem of the arm 145. The first end 150 of the arm 145 is fixed to the bottom side 45 of the seat 35.

The chair assembly 20 further includes a platform 175, detailed in FIG. 1, for placement of the limb 30 of the person 25. The limb 30 is, for instance, a leg with a foot or an arm with a hand. The platform 175 has a top side 180 and a bottom side 185. The bottom side 185 of the platform 175 is fixed to the second end 170 of the arm 145. The limb 30 of the person 25 rests upon the top side 180 of the platform 175. In one instance, the platform 175 includes a cushion placed upon the top side 180. The limb 30 of the person 25 rests upon the cushion. In another instance, illustrated in FIG. 3, the platform 175 swivels clockwise and/or counterclockwise (e.g., 360° clockwise and 360° counterclockwise). This allows a coach or a trainer to position the platform 175 for comfortable use while tending to the person 25.

Figure 2:
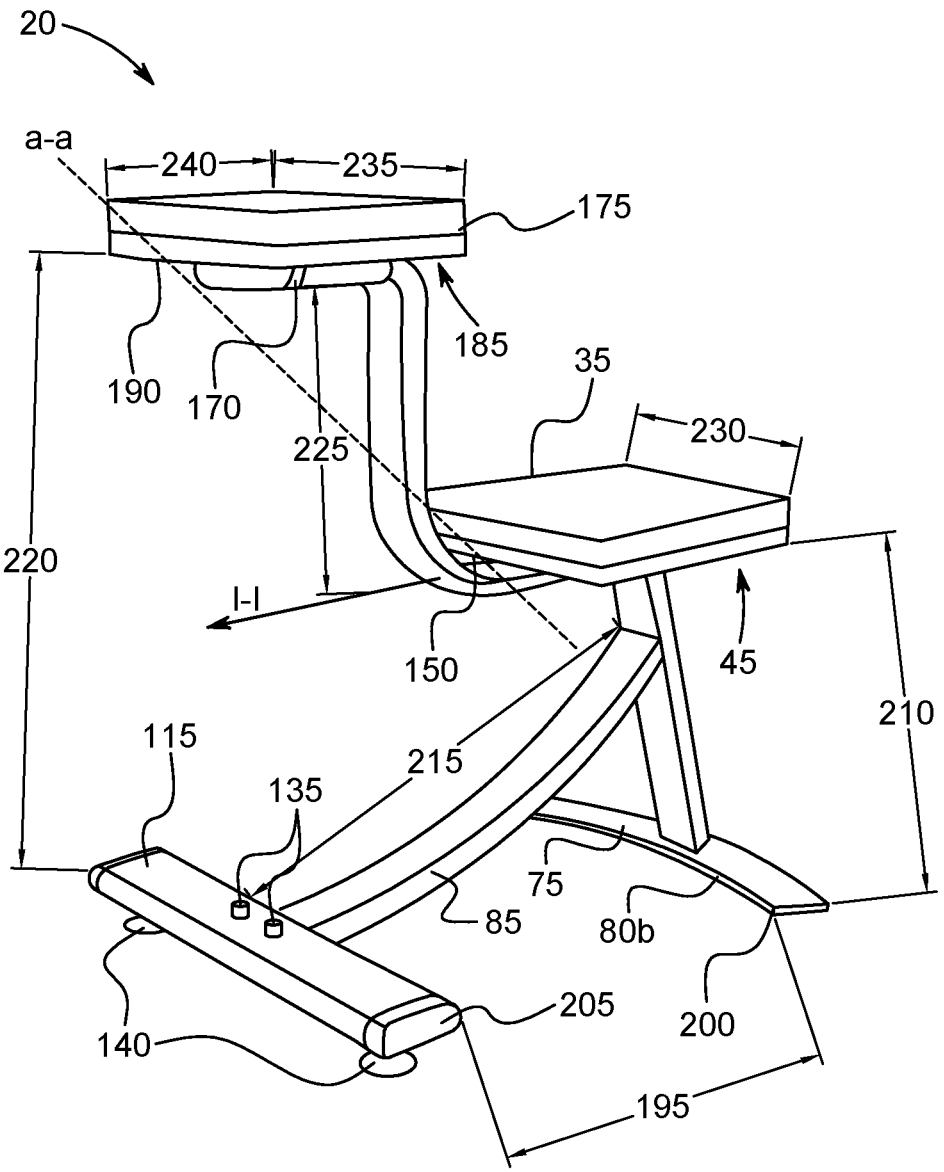
FIG. 2 is a perspective view of a chair assembly, according to an exemplary embodiment.
Figure 4:
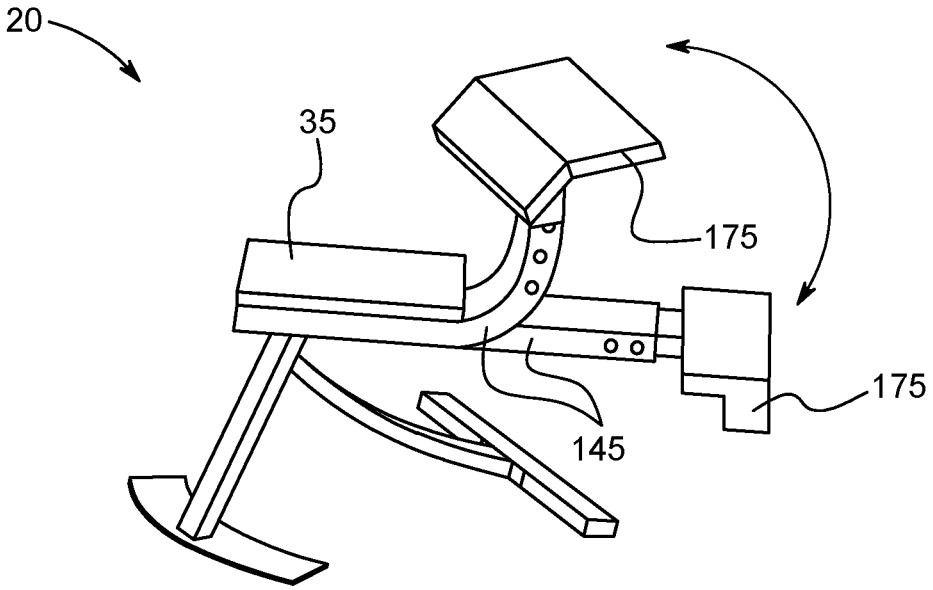
FIG. 4 is a side view of a chair assembly, according to an exemplary embodiment.

As illustrated in FIGS. 2 and 4, the seat 35 and the platform 175 are disposed with respect to each other such that an angle $\alpha$ which is the angle formed between line a-a and line I-I. Line I-I is parallel to the seat 35 and may be horizontal, for example. Line a-a is formed by connecting points 155 and 190 which are identically positioned along centers of the forward edges of the seat 35 and platform 175. α ranges between 0° and 120° as the platform is lowered and raised. Two different configurations of the arm 145 and the platform 175 are depicted in FIG. 4 for illustrative purposes only, and are not together in the chair assembly 20. In a specific embodiment, the angle α is 60°. The platform 175 is disposed relative to the seat 35 such that an individual (such as a coach or a trainer) is able to stand while treating the limb 30 of the person 25.

In a specific embodiment, detailed in FIG. 2, the chair assembly 20 has the following dimensions: the length 120 of the second foot 115 is at most 18". A distance 195 between an outermost point 200 on the inner arc length 80*b* of the first foot 75 and a point 205 on the second foot 115 facing opposite the outermost point 200 of the first foot 75 is at most 21". A distance 210 from the floor to the bottom side 45 of the seat 35 is at most 17.5". A length 215 of the secant 110 of the second leg 85 is at most 23". A distance 220 from the floor to the bottom side 185 of the platform 175 is at most 29". A distance 225 from the first inflexion point 155 of the arm 145 to the second end 170 of the arm 145 is at most 15". The seat 35 has a square profile and has a side length 230 of at most 13". The platform 175 has a rectangle profile and has a width 235 of at most 7" by a length 240 of at most 12".

Figure 5:
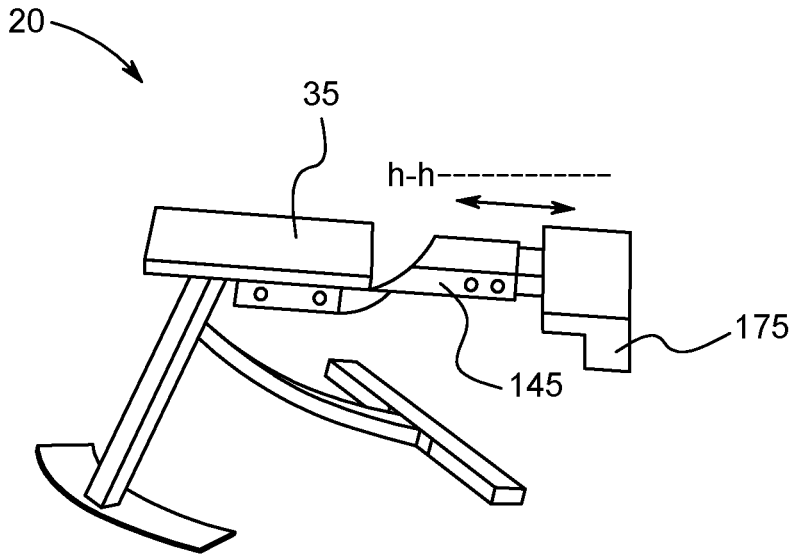
FIG. 5 is another side view of a chair assembly, according to an exemplary embodiment.

In another embodiment, depicted in FIG. 5, the arm 145 is horizontal and in-line with the seat 35. As such, the platform 175 is held in-line with the seat 35. The arm 145 can extend and contract along a longitudinal axis the arm (in this case, the horizontal axis h-h). This allows the arm 145 to be adjusted to accommodate different lengths of limbs 30 and for a coach or a trainer to position the arm 145 and the platform 175 for comfortable use while tending to the person 25. In a particular example, the arm 145 telescopes along the horizontal axis h-h to allow the platform 175 to adjust.

Figure 6:
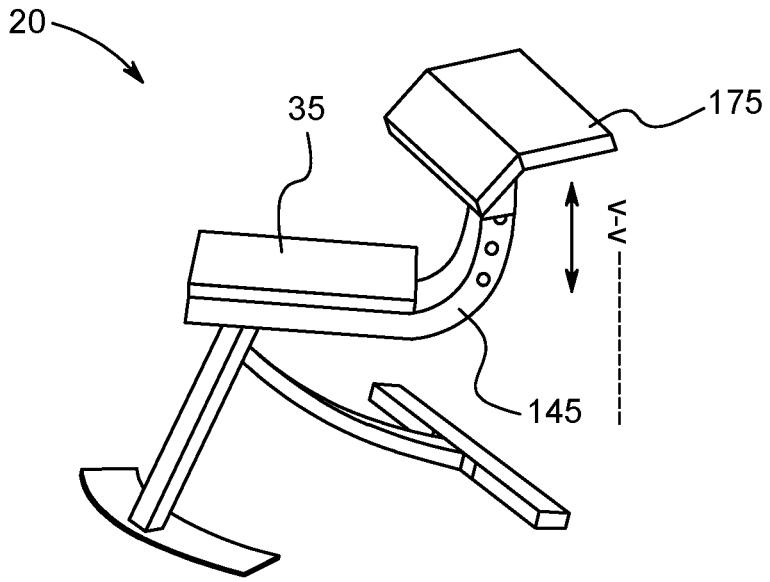
FIG. 6 is a further side view of a chair assembly, according to an exemplary embodiment.

In a further embodiment, depicted in FIG. 6, the arm 145 is vertical and holds up the platform 175. The arm 145 can extend and contract along the longitudinal axis of the arm (in this case, a vertical axis v-v). This allows the arm 145 to be adjusted to accommodate different sizes of both the person 25 and a coach or a trainer, in turn allowing the platform 175 to be adjusted along the vertical axis v-v. In a particular example, the arm 145 telescopes along the vertical axis v-v to allow the platform 175 to adjust.

Figure 7:
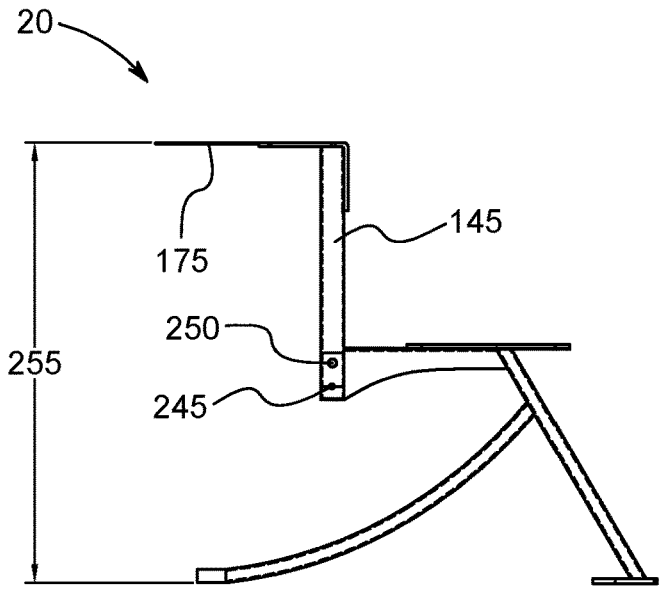
FIG. 7 is another side view of a chair assembly, according to an exemplary embodiment.

In another embodiment, depicted in FIG. 7, the platform 175 is an extension of the arm 145. A pin 245 located on the arm 145 allows the arm 145 to be extend and contract along the vertical axis v-v. The pin 245 inserts into the arm 145 and can be removed from the arm 145 to allow the arm 145 to pivot about a point 250 on the arm 145. This allows the arm 145 to pivot to different angles, for example from 0-90 degrees, to accommodate different sizes of both the person 25 and a coach or a trainer, in turn allowing the platform 175 to be adjusted along the vertical axis v-v. In one instance, the point 250 is above the pin 245. In such a setup, a distance 255 from the floor to the top side 180 of the platform 175 is 32.75". The distance 210 from the floor to the top side 40 of the seat 35 is 17.75". As detailed in FIG. 8, the pin 245 extends outward from the arm 145.

Figure 8:
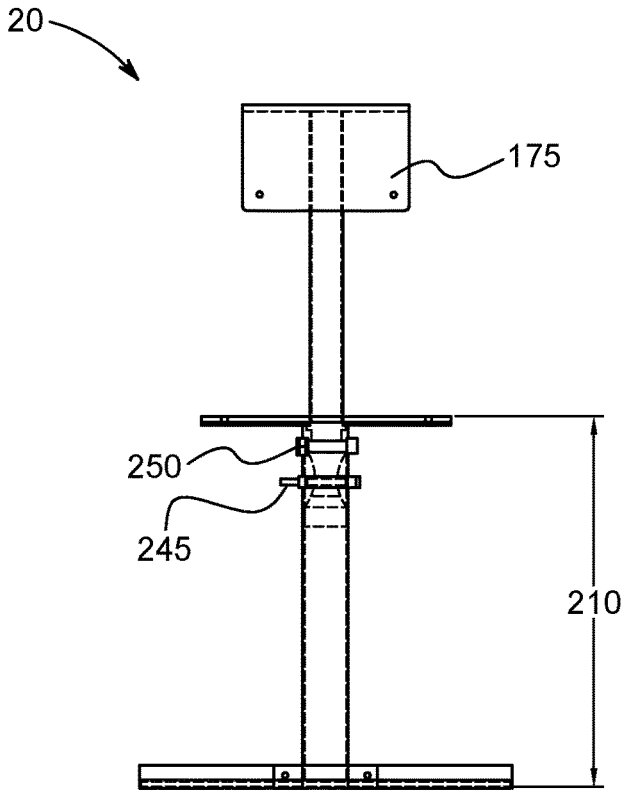
FIG. 8 is a front view of a chair assembly, according to an exemplary embodiment.
Figure 9:
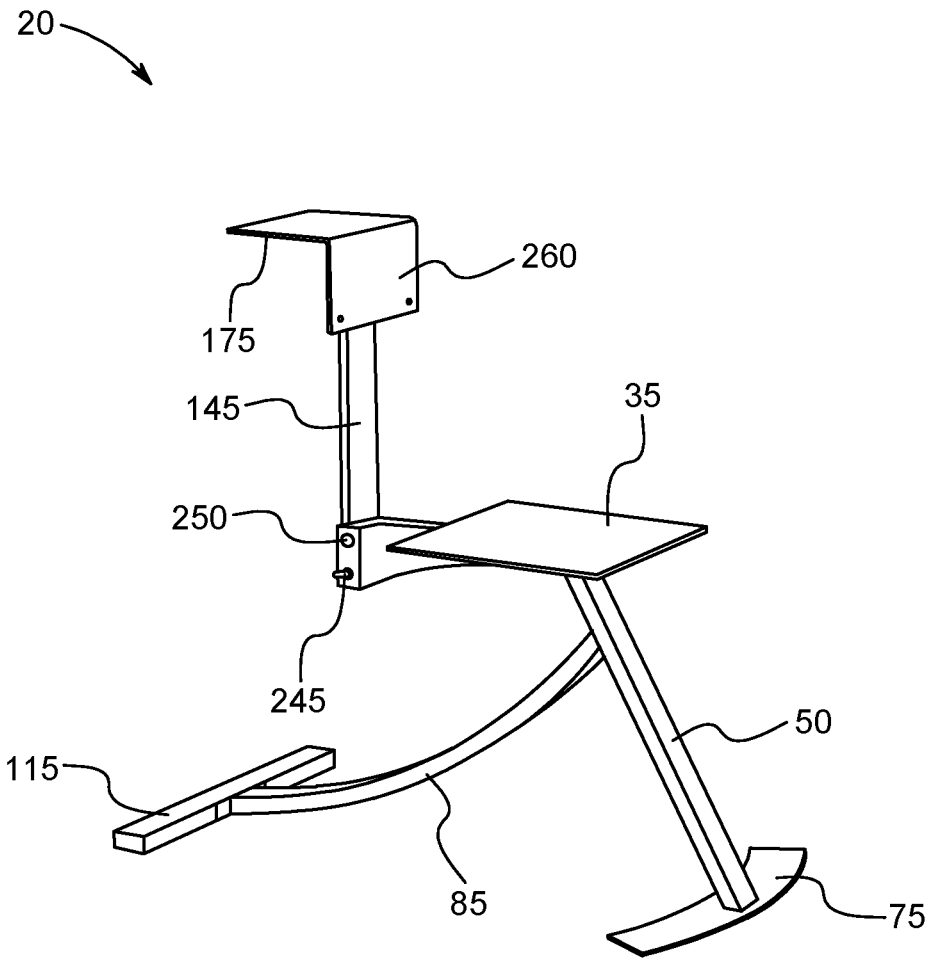
FIG. 9 is a perspective view of a chair assembly, according to an exemplary embodiment.

In the embodiments of in FIGS. 7-9, the pin 245 and the point 250 are located in lieu of the first inflexion point 155. The platform 175 has an extension 260 that extends downward from the platform 175 to the arm 145 and keeps the platform 175 attached to the arm 145, so that no second inflexion point 165 of the arm is needed to form a second end of the arm 145 which supports the bottom side of the platform 175. In one instance, the extension 260 extends downward 90° from the platform 175 to the arm 145.

In another embodiment, the chair assembly 20 sustains a maximum weight of 370 pounds.

What is claimed is:

1. A chair assembly, for allowing a person having at least one limb to sit and prop up the limb, comprising:

a seat having a top side for sitting and a bottom side; and a platform, for placement of the limb of the person, having a top side and a bottom side;

an arm having a first end joined to the seat and a second end joined to the platform;

a first leg having a length, a first end, and a second end;

a second leg having a first end, and a second end;

a second foot extending from the second end of the second leg;

wherein a height of the platform is adjustable along a longitudinal axis of the arm wherein the first end of the first leg is fixed to the bottom side of the seat, and the first leg extends downward along the length of the first leg to the second end of the first leg;

wherein the first end of the second leg is fixed to a point along the length of the first leg, and the second leg extends downward to the second end of the second leg;

wherein the second leg has a curved profile and an arc length extending downward to the second end of the second leg, wherein the second foot has a length, a top surface, and a bottom surface;

wherein a pair of screws is disposed on the top surface along the length of the second foot to fix the second foot to the second end of the second leg.

2. The chair assembly of claim 1, wherein:

the arm has the first end, a first inflexion point that is concave upward, a stem, a second inflexion point that is concave downward, and the second end;

the first end of the arm is fixed to the bottom side of the seat;

the bottom side of the platform is fixed to the second end of the arm and is configured to support the limb of the person resting upon the top side of the platform while the person is seated on the seat.

3. The chair assembly of claim 1, wherein an angle formed between a line parallel to the seat and a line connecting points centered along front edges of the respective seat and platform is between 30-60 degrees.

4. The chair assembly of claim 2, wherein at least one of inflexion points of the arm is set to curve at an angle of 90° with respect to the stem of the arm.

5. The chair assembly of claim 1, wherein the arm is configured to telescope the longitudinal axis of the arm to allow adjustment of a height of the platform.

6. The chair assembly of claim 1, wherein the arm is configured to pivot about a point on the arm.

7. The chair assembly of claim 1, wherein the first leg has a straight profile.

8. The chair assembly of claim 1, further comprising a first foot attached to the second end of the first leg;

wherein the first foot sits upon a floor.

9. The chair assembly of claim 8, wherein the first foot has a curved profile, an outer arc length, and an inner arc length.

10. The chair assembly of claim 1, wherein the second foot has a straight profile.

11. A chair assembly, for allowing a person having at least one limb to sit and prop up the limb, comprising:

a seat having a top side for sitting and a bottom side;

a first leg having a straight profile, a length, a first end, and a second end;

wherein the first end of the first leg is fixed to the bottom side of the seat, and the first leg extends downward along the length of the first leg to the second end of the first leg;

a first foot attached to the second end of the first leg;

wherein the first foot has a curved profile, an outer arc length, and an inner arc length, and sits upon a floor;

a second leg having a curved profile, an arc length, a first end, and a second end;

wherein the first end of the second leg is fixed to a point along the length of the first leg, and the second leg extends downward along the arc length of the second leg to the second end of the second leg;

a second foot extending from the second end of the second leg, the second foot having a straight profile, a length, a top surface, and a bottom surface;

wherein a pair of screws is disposed on the top surface along the length of the second foot to fix the second foot to the second end of the second leg, and a pair of grips is disposed on the bottom surface along the length of the second foot to fix the second foot to the floor;

an arm having a first end, a first inflexion point that is concave upward, a stem, a second inflexion point that is concave downward, and a second end;

wherein both inflexion points of the arm are each set to curve at an angle of 90° with respect to the stem of the arm;

wherein the first end of the arm is fixed to the bottom side of the seat; and a platform, for placement of the limb of the person, having a top side and a bottom side;

wherein the bottom side of the platform is fixed to the second end of the arm, and the limb of the person rests upon the top side of the platform;

wherein an angle formed between a line parallel to the seat and a line connecting points centered along front edges of the respective seat and platform is between 0-120 degrees.

12. A chair assembly, for allowing a person having at least one limb to sit and prop up the limb, comprising:

a seat having a top side for sitting and a bottom side; and a platform, for placement of the limb of the person, having a top side and a bottom side;

an arm having a first end joined to the seat and a second end joined to the platform;

a first leg having a length, a first end, and a second end;

a second leg having a first end, and a second end;

a second foot extending from the second end of the second leg;

wherein a height of the platform is adjustable along a longitudinal axis of the arm wherein the first end of the first leg is fixed to the bottom side of the seat, and the first leg extends downward along the length of the first leg to the second end of the first leg;

wherein the first end of the second leg is fixed to a point along the length of the first leg, and the second leg extends downward to the second end of the second leg;

wherein the second leg has a curved profile and an arc length extending downward to the second end of the second leg;

wherein the second foot has a length, a top surface, and a bottom surface;

wherein a pair of grips is disposed on the bottom surface along the length of the second foot to fix the second foot to the floor.

* * * * *